US005760533A

United States Patent [19]

Saiki et al.

[11] Patent Number: 5,760,533

[45] Date of Patent: Jun. 2, 1998

[54] SPARK PLUG FOR AN INTERNAL COMBUSTION ENGINE

[75] Inventors: Yoshiaki Saiki; Minoru Ando; Mitsutaka Yoshida, all of Nagoya, Japan

[73] Assignee: NGK Spark Plug Co., Ltd., Nagoya, Japan

[21] Appl. No.: 622,170

[22] Filed: Mar. 27, 1996

[30] Foreign Application Priority Data

Mar. 31, 1995 [JP] Japan ..... 7-075358

[51] Int. Cl.[6] ..... H01T 13/04; H01T 13/20

[52] U.S. Cl. ..... 313/137; 313/135; 313/140; 313/141; 313/142

[58] Field of Search ..... 313/118, 119, 313/124, 134–135, 137, 141, 142, 143, 144

[56] References Cited

U.S. PATENT DOCUMENTS

| | | | |
|---|---|---|---|
| 2,806,971 | 9/1957 | Twells et al. | 313/118 |
| 3,452,235 | 6/1969 | Hallauer et al. | 313/141 X |
| 3,903,453 | 9/1975 | Nishio | 313/118 X |
| 4,029,990 | 6/1977 | Nagy et al. | 313/124 X |
| 4,460,847 | 7/1984 | Englehardt | 313/136 X |
| 4,568,855 | 2/1986 | Nemeth et al. | 313/134 X |
| 5,095,242 | 3/1992 | Richeson | 313/137 X |

FOREIGN PATENT DOCUMENTS

| | | | |
|---|---|---|---|
| 0622881 | 11/1994 | European Pat. Off. | H01T 13/38 |
| 57-76391 | 5/1982 | Japan | H01T 13/02 |
| 447691 | 2/1992 | Japan | H01T 13/20 |

*Primary Examiner*—Sandra L. O'Shea
*Assistant Examiner*—Mark Haynes
*Attorney, Agent, or Firm*—Sughrue, Mion, Zinn, Macpeak & Seas, PLLC

[57] ABSTRACT

In a spark plug, a tubular insulator has an axial bore in which a center electrode and a terminal electrode are axially aligned, the terminal electrode having a seal portion fixedly supported by partly filling the axial bore with a glass sealant. The insulator further has a tapered shoulder portion between a diameter-reduced portion and a diameter-increased portion, each provided on the insulator. A metallic shell is placed around the diameter-increased portion of the insulator, a rear end of the metallic shell being caulked against the diameter-reduced portion of the insulator, a space between the metallic shell and the diameter-reduced portion of the insulator being filled with a ceramic powder. An inclination of the tapered shoulder portion of the insulator ranges from 10 to 45 degrees against a plane perpendicular to the terminal electrode. A roulette is formed on an outer surface of the seal portion of the terminal electrode in which the glass sealant is filled. A front end of the seal portion of the terminal electrode is located in the range of +5.0 mm to −1.0 mm from a boundary where the tapered shoulder portion meets the diameter-increased portion of the insulator.

5 Claims, 5 Drawing Sheets

| specimen | A | B | C | D | E | F |
|---|---|---|---|---|---|---|
| outer configuration of terminal electrode | male thread | roulette | male thread | roulette | male thread | roulette |
| structure |  | |  | |  | |

| specimen | G | H | I |
|---|---|---|---|
| outer configuration of terminal electrode | roulette | roulette | roulette |
| structure |  |  |  |

| specimen | J | K |
|---|---|---|
| outer configuration of terminal electrode | roulette (45°) | roulette (45°) |
| structure |  |  |

SPARK PLUG FOR AN INTERNAL COMBUSTION ENGINE

BACKGROUND OF THE INVENTION

Field of the Invention

This invention relates to a spark plug in which a center electrode and a terminal electrode are fixedly placed in a tubular insulator by means of a glass sealant, and a rear end of a metallic shell is turned against the insulator by means of a caulking.

DESCRIPTION OF THE PRIOR ART

In a spark plug 100 shown in FIG. 6, there has been provided an insulator 2 which has a diameter-increased middle portion and diameter-reduced portion at front and rear portions. Within an interior of the insulator 2, an axial bore 21 is provided together with a stepped portion formed on an inner surface of the insulator 2. A center electrode 3 has a flange stopper 32, and is inserted to the axial bore 21. Then, a resistor 8 is inserted to the axial bore 21 with both ends of the resistor 8 press loaded by a glass sealant 7. Into the axial bore 21, a terminal electrode 6 is inserted whose front end portion has a male thread 65 to strengthen the connection with the glass sealant 7 as shown in FIG. 6*a*. Thereafter, the glass sealant 7 and the resistor 8 are meltingly heated to tightly adhere the center and terminal electrodes 3, 6 to the insulator 2 while depressing the terminal electrode 6 into the axial bore 21.

Around the insulator 2, a metallic shell 4 is placed whose front end has a ground electrode 5 to oppose a front end 3*a* of the center electrode 3. Upon completing the assembly of the spark plug 100, a rear end 43 of the metallic shell 4 is turned or caulked against the insulator 2 with an appropriate powder 9 loaded between the metallic shell 4 and the insulator 2. In this instance, the insulator 2 has a tapered shoulder portion 28 between a diameter-increased portion 26 and the diameter-reduced portion 25 of the insulator 2. The tapered shoulder portion 28 forms an angle of about 60 degrees against a plane F perpendicular to an axial direction of the center electrode 3. Between the tapered shoulder portion 28 and the caulking end 43 of the metallic shell 4, an annular space is provided to accommodate the appropriate powder 9.

However, with the descent of the temperature of the glass sealant 7 which tightly adhere the center and terminal electrodes 3, 6 to the inner surface of the insulator 2, a tensile stress appears at a boundary between the terminal electrode 6 and the glass sealant 7 due to the pulling force to which the terminal electrode 6 and the glass sealant 7 are oppositely subjected. The residual stress works in a direction to tear off the insulator 2 axially since the center and terminal electrodes 3, 6 are tightly adhered to the inner surface of the insulator 2. It is for this reason that the insulator 2 tends to rupture at an interface (A) between the terminal electrode 6 and the glass sealant 7 especially at the time when an excessive force is accidentally applied on the insulator 2 and the terminal electrode 6 upon being exposed to vibration from an engine or assembling the insulator 2 to the metallic shell 4. This is all the more serious when a front end 62 of the terminal electrode 6 resides in the proximity of the tapered shoulder portion 28 of the insulator 2.

In order to prevent the rupture of the insulator 2, the inventors of the present patent application have been carrying out various experimental tests to newly find that the following points may be taken into consideration to impart the insulator with durability by dispersing the tensile stress set up at the boundary between the terminal electrode 6 and the glass sealant 7:

(i) the relative position of the front end of the terminal electrode and the diameter-increased portion of the insulator, (ii) the inclination degree of the tapered shoulder portion of the insulator, (iii) the configuration of an outer surface of the front end portion of the terminal electrode to which the glass sealant is adhered.

Therefore, it is one of the main objects of the invention to provide a spark plug which is capable of preventing an insulator from accidentally rupturing by improving the physical durability of the insulator in which a center electrode and a terminal electrode are fixedly placed by means of a glass sealant.

SUMMARY OF THE INVENTION

According to the present invention, there is provided a spark plug comprising: a tubular insulator having an axial bore in which a center electrode and a terminal electrode are axially aligned, the terminal electrode having a seal portion to be fixedly supported by partly filling the axial bore with a glass sealant; the insulator having a tapered shoulder portion between a diameter-reduced portion and a diameter-increased portion each provided on the insulator; a metallic shell placed around the diameter-increased portion of the insulator, a rear end of the metallic shell being turned or caulked against the diameter-reduced portion of the insulator, and thereby filling a space between the metallic shell and the diameter-reduced portion of the insulator with a ceramic powder; an inclination of the tapered shoulder portion of the insulator ranging from 10 to 45 degrees against a plane perpendicular to the terminal electrode; roulette being formed on an outer surface of the seal portion of the terminal electrode in which the glass sealant is filled; and a front end of the seal portion of the terminal electrode being in the range of +5.0 mm to −1.0 mm with a boundary between the tapered shoulder portion and the diameter-increased portion of the insulator as a reference point.

According to another aspect of the present invention, the roulette provided on an outer surface of the seal portion of the terminal electrode forms an angle ranging from 15 to 25 degrees against a plane perpendicular to the terminal electrode.

With the inclination of the tapered shoulder portion of the insulator ranging from 10 to 45 degrees against a plane perpendicular to the terminal electrode, and the front end of the seal portion being in the range of +5.0 mm to −1.0 mm with the boundary between the tapered shoulder portion and the diameter-increased portion as a reference point, the front end of the terminal electrode is placed in the proximity of an interface between the diameter-reduced portion and the tapered shoulder portion of the insulator. With the increase of the inclination of the tapered shoulder portion, a lateral force component applied on the tapered shoulder portion increases when caulking the rear end of the metallic shell, while on the other hand, the lateral force component applied on the tapered shoulder portion decreases as the inclination of the tapered shoulder portion increases. By determining the inclination of the tapered shoulder portion to be less than 45 degrees, it is possible to mitigate the tensile stress so as to improve the physical durability of the insulator when the center electrode and terminal electrode are sealed within the insulator by means of the glass sealant.

With the roulette provided on the outer surface of the seal portion of the terminal electrode, it is possible to strengthen an adhesion between the front end of the terminal electrode and the glass sealant due to a streak of grooves left by forming the roulette. In comparison with the case in which a male thread is provided on the terminal electrode, it is possible to mitigate the internal stress set up between the glass sealant and the grooves of the roulette since the width of the grooves is reduced. For this reason, it is possible to ease the stress while maintaining the necessary strength of the adhesion between the front end of the terminal electrode and the glass sealant so as to impart the insulator with an appropriate durability.

When the inclination of the tapered shoulder portion of the insulator is less than 10 degrees against a plane perpendicular to the terminal electrode, the tapered shoulder portion nears a right angle against the terminal electrode so that the tapered shoulder portion is likely to be broken during the honing operation. In order to avoid this inconvenience, it is necessary to taper the shoulder portion at least 10 degrees.

The roulette provided on an outer surface of the seal portion of the terminal electrode forms an angle ranging from 15 to 25 degrees against a plane perpendicular to the terminal electrode. In this instance, it is advantageous as the angle decreases within the technical limit in which the roulette can be machined on the outer surface of the terminal electrode.

To summarize the present invention, it is possible to disperse the stress set up between the terminal electrode and the glass sealant after meltingly heating the glass sealant so as to strengthen the insulator against an exterior force by decreasing the inclination of the tapered shoulder portion, although the front end of the terminal electrode resides in the proximity of the boundary between the diameter-reduced portion and the tapered shoulder portion of the insulator.

With the roulette provided on an outer surface of the seal portion of the terminal electrode, it is possible to reduce the stress while maintaining the necessary strength of the adhesion between the front end of the terminal electrode and the glass sealant so as to secure the appropriate durability of the insulator.

BRIEF DESCRIPTION OF THE DRAWINGS

These and other objects, aspect and embodiments of the invention will be described in more detail with reference to the following figures, of which.

DETAILED DESCRIPTION OF PREFERRED EMBODIMENTS OF THE INVENTION

Figure 1:
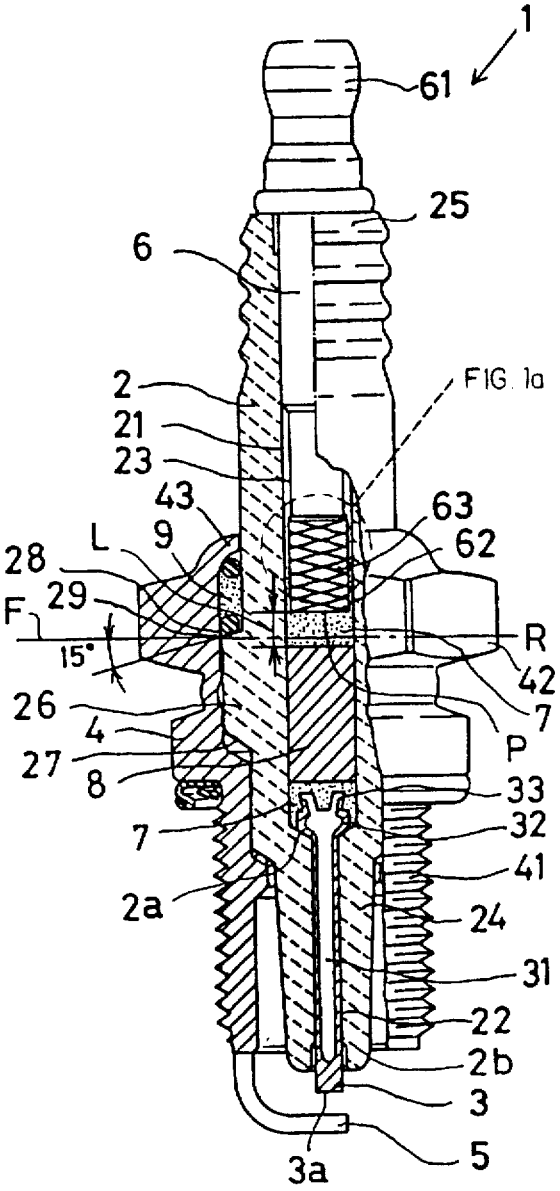
FIG. 1 is a longitudinal cross sectional view of a spark plug according to an embodiment of the invention.
Figure 1A:
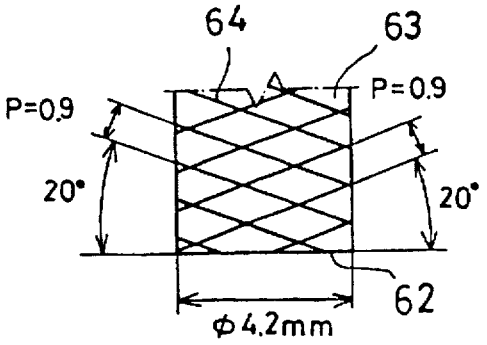
FIG. 1*a* is a magnified portion of a terminal electrode shown in FIG. 1.

Referring to FIG. 1, a spark plug 1 has a tubular insulator 2, a center electrode 3, a metallic shell 4, an outer electrode 5, a terminal electrode 6, a glass sealant 7, a resistor 8 and a ceramic powder 9 including a talc ring.

The insulator 2 is made from alumina in a manner to serve its inner space as the axial bore 21. On an inner surface of the insulator 2, a step portion 2*a* is provided at an interface between a diameter-reduced front hole 22 and a diameter-increased rear hole 23 of the axial bore 21. The center electrode 3 is placed within the diameter-reduced front hole 22, while the glass sealant 7, the resistor 8 and the terminal electrode 6 are in turn placed within the diameter-increased rear hole 23. An outer surface of the insulator 2 has diameter-reduced portions 24, 25 at both rear and front end portions of the insulator 2, and at the same time has the diameter-increased portion 26 at a middle portion of the insulator 2. The diameter-increased portion 26 has tapered shoulder portions 27, 28 at an interface of the diameter-reduced portions 24, 25. The inclination of the tapered shoulder portion 28 ranges from 10 to 45 degrees against a plane (F) perpendicular to an axial direction to the terminal electrode 6 (i.e., the insulator 2 and the center electrode 3). In this instance, the tapered shoulder portion 28 substantially forms an angle of 15 degrees.

The center electrode 3 has a copper core cladded by a nickel metal. The center electrode 3 forms a leg portion 31 whose front end extends beyond a front end 2*b* of the insulator 2, while a rear end of the center electrode 3 has a flange portion 32 and a head portion 33 each of which is disposed in the diameter-increased rear hole 23.

The metallic shell 4 is made of a cylindrical mild steel whose front portion corresponds to the diameter-reduced portion 24 of the insulator, and having a male thread 41 at an outer surface of the front portion of the metallic shell 4. A rear portion of the metallic shell 4 corresponds to the tapered shoulder portion 28, and an outer surface of the rear portion forms a hexagonal nut 42 which is used to attach the spark plug 1 to an internal combustion engine. A distal rear end 43 of the metallic shell 4 is thinned to be caulked against an outer surface of the insulator 2. To a front end of the metallic shell 4, the outer electrode 5 is welded to oppose a front end 3*a* of the center electrode 3.

The terminal electrode 6 is placed within the diameter-increased rear hole 23 of the insulator 2, and has a rear end terminal 61 disposed outside the axial bore 21 so that the terminal 61 engages a plug cap of an ignition unit (not shown). The terminal electrode 6 has a front end 62 whose outer surface 63 is provided with a plurality of streaks of roulette 64 so as to strengthen adhesion between the terminal electrode 6 and the glass sealant 7. The streaks of roulette 64 are arranged in regular intervals (0.9 mm) on the terminal electrode 6 of, e. g., 4.2 mm in diameter. The streaks of roulette 64 form an angle of 15 to 25 degrees with the plane (F) perpendicular to the axial direction of the terminal electrode 6. In this instance, the streaks of roulette 64 substantially form an angle of 20 degrees.

The front end 62 of the terminal electrode 6 is positioned within a range (L) of +5.0 mm to −1.0 mm from an interface edge 29 between the tapered shoulder portion 28 and the diameter-increased portion 26 as a reference point (R). In other words, the front end 62 of the terminal electrode 6 is disposed as designated by (P) at a position near a boundary between the tapered shoulder portion 28 and the diameter-reduced portion 25 of the insulator 2. With the positional arrangement of the front end 62 of the terminal electrode 6, it is possible to dispersively relax the tensile stress which works to pull the insulator toward the rear end terminal 61, with the lateral force mitigated by decreasing the tapered shoulder portion 28 in the range of 10 to 45 degrees.

The glass sealant 7 is made of a meltingly heated mixture of vitreous powder and metal powder. The resistor 8 is made of a meltingly heated mixture of carbon powder, metal powder, vitreous powder and metal oxide powder. The glass sealant 7 and the resistor 8 are formed in the following manner when the center electrode 3 and the terminal electrode 6 are assembled to the insulator 2.

To the axial bore 21 of the insulator 2, the leg portion 31 of the center electrode 3 is inserted to engage the flange stopper 32 with the step portion 2*a* inside the insulator 2. Then, the glass sealant 7, the resistor 8, and the glass sealant 7 are loaded in turn into the axial bore 21 of the insulator 2. Thereafter, the terminal electrode 6 is inserted into the insulator 2 from its front end 62, and the insulator 2 is heated to thermally melt the glass sealant 7 and the resistor 8 while the terminal electrode 6 is pressed against the glass sealant 7. With this heat treatment, it is possible to adhere the front end 62 and the outer surface 63 of the terminal electrode 6 to the inner surface of the insulator 2, while at the same time tightly adhering the flange stopper 32 and the head portion 33 to the inner surface of the insulator 2.

Around the insulator 2 having the center electrode 3 and the terminal electrode 6 thus integrally moulded, the metallic shell 4 is placed to accommodate the ceramic powder 9 into an annular space formed by the hexagonal nut 42 of the metallic shell 4, the tapered shoulder portion 28 and an outer surface of the insulator 2. Then, upon completing the spark plug 1, the rear end 43 of the metallic shell 4 is caulked against the outer surface of the insulator 2.

Figure 2:
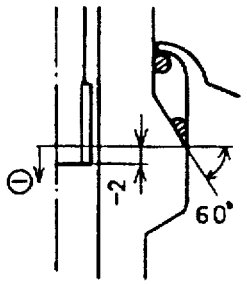
FIG. 2 is a table showing various specimens of different structure to explain advantages obtained by the present invention.
Figure 2:
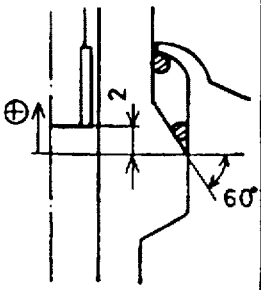
Figure 2:
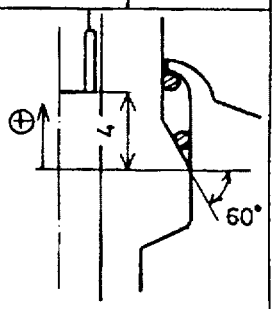
Figure 2:
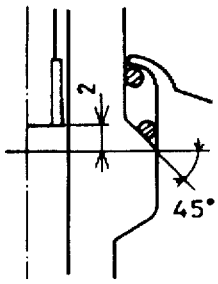
Figure 2:
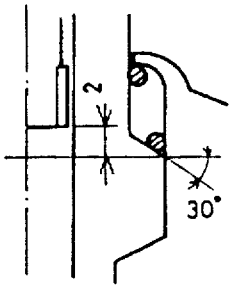
Figure 2:
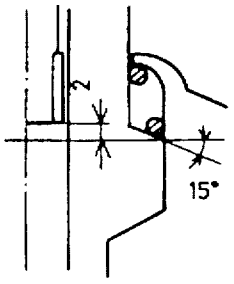
Figure 2:
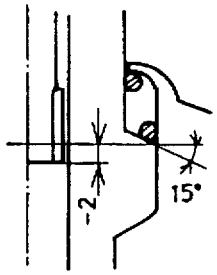
Figure 2:
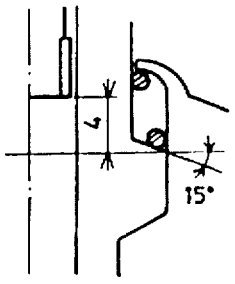
Figure 3A:
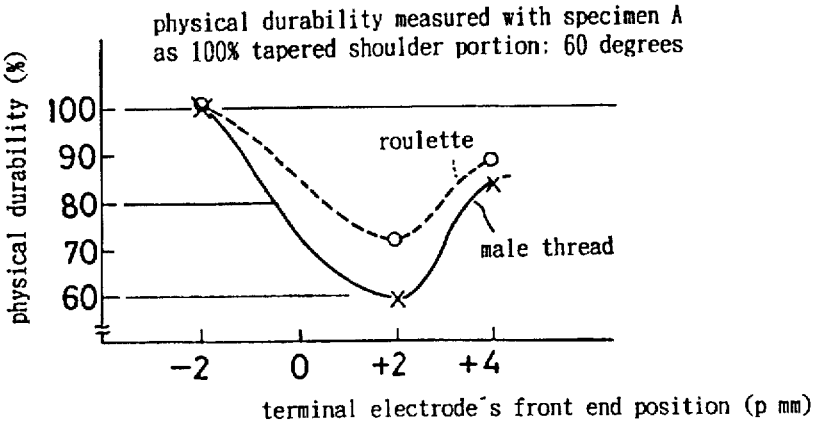
FIGS. 3*a* through 3*c* are characteristic curves showing the physical strength of an insulator according to the different structure of FIG. 2.
Figure 3B:
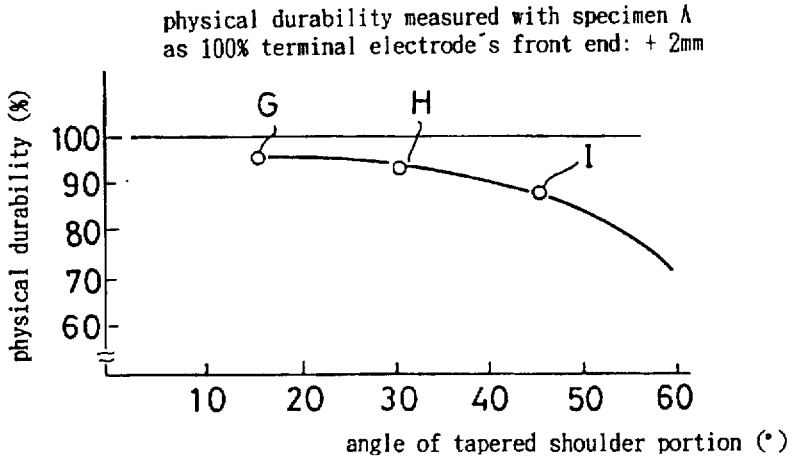
Figure 3C:
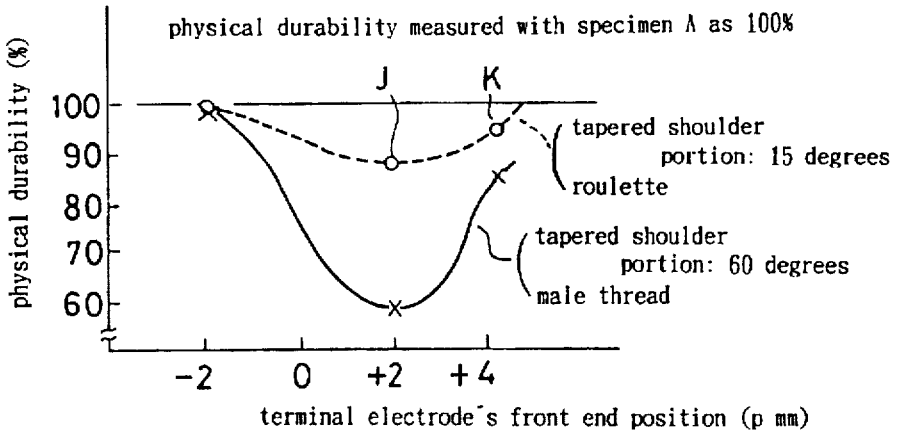
Figure 4:
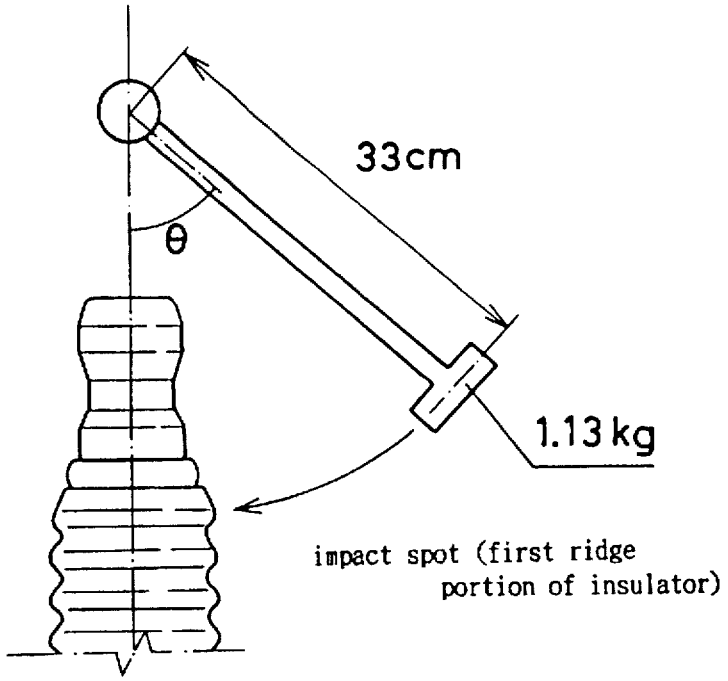
FIG. 4 is an schematic view of a impact test device used to obtain the characteristic curves of FIG. 3*a* through 3*c*.

FIG. 2 depicts specimens of different structure in order to show how the physical durability of the insulator 2 varies depending on the structural difference between the relative position of the front end 62 of the terminal electrode 6, the inclination of the tapered shoulder portion 28 and the outer configuration of the front end 62 of the terminal electrode 6. Experimental test results are shown in FIGS. 3*a* through 3*c*. In this instance, an impact unit is used as shown in FIG. 4 to measure the physical durability of the insulator with a first ridge of the rear end of the insulator as an impact spot. The impact measurements are calculated in terms of angle (θ) at which the insulator is broken.

As understood by referring from FIG. 2 to characteristic curves in FIGS. 3*a* through 3*c*, it is found that the physical durability is ameliorated with the decrease of the inclination of the tapered shoulder portion 28 when the front end 62 of the terminal electrode 6 is positioned in the range of +5.0 mm to −1.0 mm with an interface edge 29 between the tapered shoulder portion 28 and the diameter-increased portion 26 as the reference point (R).

With the roulette 64 provided on the outer surface 63 of the front portion 62 of the terminal electrode 6, it is possible to improve the physical durability of the insulator 2 compared to the case in which the male thread is provided.

Although the physical durability is strengthened as the inclination of the tapered shoulder portion 28 decreases, the tapered shoulder portion 28 needs at least 10 degrees since it may be broken during the honing operation when the tapered shoulder portion 28 is short of 10 degrees.

Figure 5:
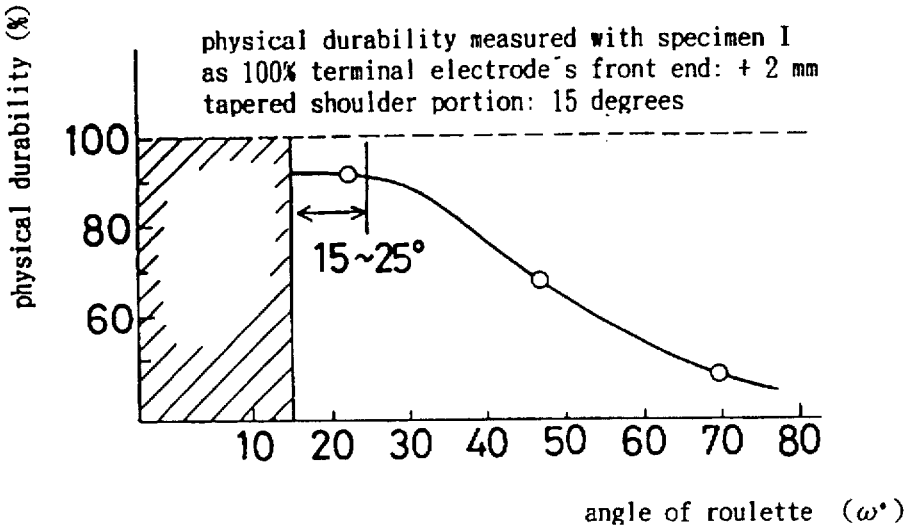
FIG. 5 is a characteristic curve showing a relationship between an angle of the roulette and the physical strength of the insulator.
Figure 6:
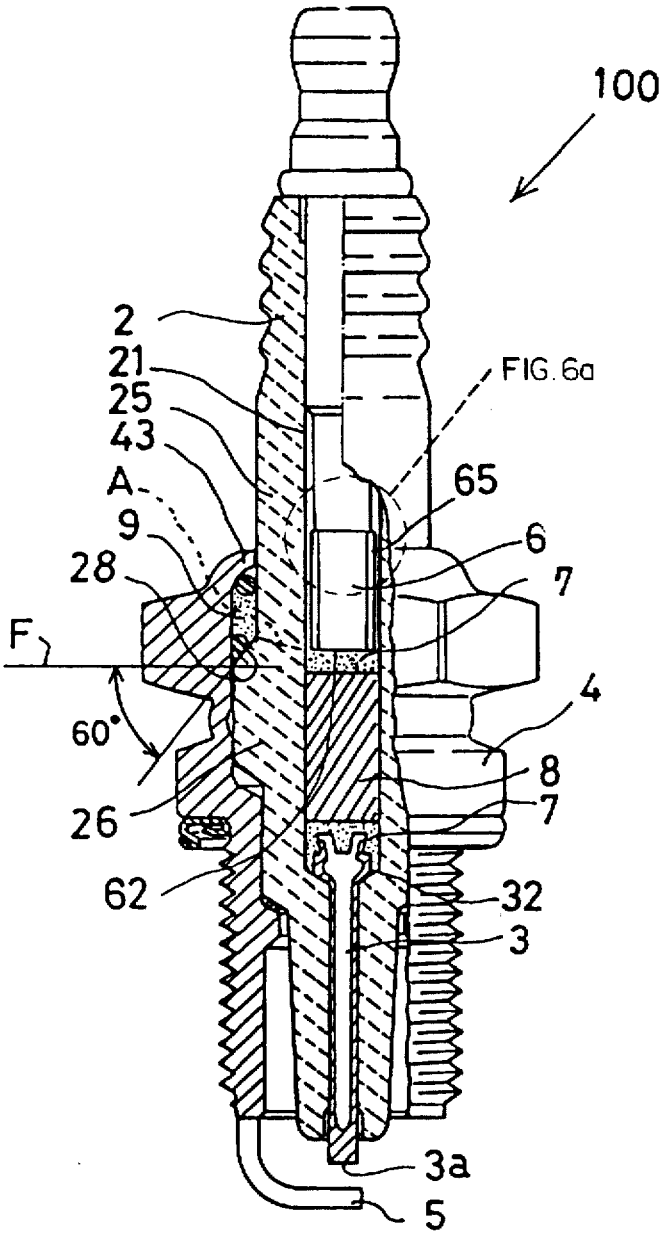
PRIOR ART Fig. 6
FIG. 6 is a longitudinal cross sectional view of a prior art spark plug.
Figure 6A:
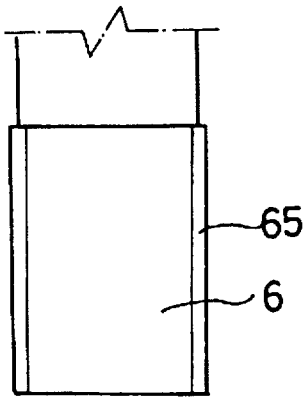
PRIOR ART Fig. 6a
FIG. 6*a* is a magnified portion of a terminal electrode shown in FIG. 6.

FIG. 5 shows a relationship between an angle (ω) of the roulette 64 and the physical durability of the insulator 2 when the tapered shoulder portion 28 forms an angle of 15 degrees, while the front end 62 of the terminal electrode 6 is positioned +2.0 mm from the reference point (R). It is found that the physical durability is strengthened as long as the angle of the roulette 64 is from 15 to 25 degrees, but it deteriorates with the angular increase of the roulette 64. When the angle of the roulette 64 becomes less than 15 degrees, it is impossible to provide the roulette 64 on the outer surface 63 of the terminal electrode 6 because the roulette-forming force squelches it into an elliptical deformation, thus rendering it unable to hold a circular cross section of the terminal electrode 6.

As apparent from the foregoing description, if the front end 62 of the terminal electrode 6 is positioned within a range of +5.0 mm to −1.0 mm from the interface edge 29 between the tapered shoulder portion 28 and the diameter-increased portion 26 as indicated by the reference point (R), and the tapered shoulder portion 28 forms from an angle of 10 to 45 degrees on the roulette 64 provided with the outer surface 63 of the terminal electrode 6, it is possible to dispersively relax the tensile stress set up in the insulator 2 so as to strengthen the physical durability of the insulator 2 against the exterior forces. This holds especially true in a spark plug 1 in which the front end 62 of the terminal electrode 6 is placed in the proximity of the tapered shoulder portion 28 because the resistor 8 is provided within the axial bore 21 of the insulator 2.

While the invention has been described with reference to the specific embodiments, it is understood that this description is not to be construed in a limiting sense in as much as various modifications and additions to the specific embodiments may be made by skilled artisans without departing from the scope of the invention.

What is claimed is:

1. A spark plug comprising:

a tubular insulator having an axial bore in which a center electrode and a terminal electrode are axially aligned, the terminal electrode having a seal portion fixedly supported by partly filling the axial bore with a glass sealant;

the insulator having a tapered shoulder portion between a diameter-reduced portion and a diameter-increased portion, the diameter reduced and diameter increased portions being provided on the insulator;

a metallic shell placed around the diameter-increased portion of the insulator, a rear end of the metallic shell being caulked against the diameter-reduced portion of the insulator, a space between the metallic shell and diameter-reduced portion of the insulator being filled with a ceramic powder;

an inclination of the tapered shoulder portion of the insulator ranging from 10 to 45 degrees against a plane perpendicular to the terminal electrode;

a roulette being formed on an outer surface of the seal portion of the terminal electrode in which the glass sealant is filled; and a front end portion of the seal portion of the terminal electrode being located in the range of +5.0 mm to −1.0 mm from a boundary where the tapered shoulder portion meets the diameter-increased portion of the insulator.

2. The spark plug as recited in claim 1, wherein the roulette provided on an outer surface of the seal portion of the terminal electrode forms an angle ranging from 15 to 25 degrees against a plane perpendicular to the terminal electrode.

3. The spark plug as recited in claim 1, wherein the ceramic powder is talc.

4. The spark plug as recited in claim 1, wherein a resistor is provided between the terminal electrode and the center electrode.

5. The spark plug as recited in claim 4, wherein the resistor is made by thermally melting a mixture of carbon powder, metal powder, glass powder and metallic oxide powder.

* * * * *